US005560468A

United States Patent [19]

Inoue

[11] Patent Number: 5,560,468

[45] Date of Patent: Oct. 1, 1996

[54] LATERALLY ADJUSTABLE SIDE INSERTS FOR THE STEPS OF ESCALATORS AND MOVING WALKWAYS PALLETS

[75] Inventor: Takao Inoue, Lebanon, Ohio

[73] Assignee: Fujitec America, Inc., Lebanon, Ohio

[21] Appl. No.: 324,790

[22] Filed: Oct. 18, 1994

[51] Int. Cl.[6] ..... B66B 23/12

[52] U.S. Cl. ..... 198/333

[58] Field of Search ..... 198/333

[56] References Cited

U.S. PATENT DOCUMENTS

| | | | |
|---|---|---|---|
| 2,535,501 | 12/1950 | Loughridge . | |
| 2,813,613 | 11/1957 | Margles . | |
| 2,981,397 | 4/1961 | Hansen . | |
| 3,144,118 | 8/1964 | Fabula . | |
| 3,191,743 | 6/1965 | Rissler et al. . | |
| 3,986,595 | 10/1976 | Asano et al. . | |
| 4,236,623 | 12/1980 | Ackert . | |
| 4,362,232 | 12/1982 | Saito et al. | 198/333 |
| 4,374,558 | 2/1983 | Saito . | |
| 4,397,383 | 8/1983 | James . | |
| 4,413,719 | 11/1983 | White . | |
| 4,519,490 | 5/1985 | White . | |
| 4,570,781 | 2/1986 | Kappenhagen | 198/333 |
| 4,858,745 | 8/1989 | Haas et al. | 198/333 |
| 5,242,042 | 9/1993 | Mauldin | 198/333 |

FOREIGN PATENT DOCUMENTS

| | | | |
|---|---|---|---|
| 1100894 | 8/1956 | Germany . | |
| 2161442 | 12/1971 | Germany . | |
| 2518440 | 4/1975 | Germany . | |
| 2557226 | 12/1975 | Germany . | |
| 2642149 | 9/1976 | Germany . | |
| 50-18685 | 8/1975 | Japan . | |
| 50-61092 | 11/1975 | Japan . | |
| 51-41379 | 4/1976 | Japan . | |
| 51-41378 | 4/1976 | Japan . | |
| 519149 | 10/1938 | United Kingdom . | |
| 1165867 | 9/1968 | United Kingdom . | |
| 1276922 | 2/1969 | United Kingdom . | |
| 2087331 | 5/1982 | United Kingdom | 198/333 |

*Primary Examiner*—Joseph E. Valenza
*Attorney, Agent, or Firm*—Frost & Jacobs

[57] ABSTRACT

Inserts mountable on the top surface of the treads of escalator steps and walkway segments enabling adjustment of the gap between the ends of the tread and the adjacent balustrade skirts. The top surface of each tread is provided with evenly spaced ribs defining grooves therebetween and extending from the front edge to the rear edge of the tread. At its sides, the tread top surface has recessed planar unribbed surfaces extending from the front edge to the rear edge of the tread. A pair of plastic inserts is provided for each tread. The inserts are mirror images of each other and have ribs extending from their forward edges to their rearward edges, and having the same spacing as the tread ribs. The inserts are mountable on the recessed planar surfaces of the tread and extend from the forward edge to the rearward edge thereof. The outer edge of each insert has a downwardly depending flange covering the adjacent side edge of the tread. The inserts are laterally adjustable to enable minimizing of the gap between each tread side and the adjacent balustrade skirt. Inserts may also be affixed to the riser side edges in the case of an escalator step.

15 Claims, 5 Drawing Sheets

LATERALLY ADJUSTABLE SIDE INSERTS FOR THE STEPS OF ESCALATORS AND MOVING WALKWAYS PALLETS

TECHNICAL FIELD

The invention relates to moving stairways and walkways of the type having a continuous procession of treads moving between a pair of balustrade skirts, and more particularly to laterally adjustable tread inserts mountable in recessed areas formed at the sides of each tread, enabling minimization of the gap between each tread side and the adjacent skirt.

BACKGROUND ART

For purposes of an exemplary showing, the present invention will be described in its application to moving stairways or escalators. As will be abundantly apparent to one skilled in the art, the teachings of the present invention are equally applicable to walkways of the type comprising an endless procession of tread segments or pallets moving between a pair of balustrade skirts.

As is well known in the art, the typical escalator comprises a plurality of steps which are operatively joined together in a pivotal fashion to form an endless loop of steps. Each step comprises a pair of side frames which supports a substantially planar tread and an arcuate riser. Each step has a first pair of shaft mounted wheels located to either side thereof and substantially beneath the riser. Each step has second pair of shaft mounted wheels located near the opposite end of the tread remote from the riser. The shaft of the second set of wheels is also operatively attached to a pair of chains which passes over an upper pair of sprocket wheels at the upper end of the escalator and a lower pair of sprocket wheels at the lower end of the escalator. One of the upper and lower sprocket wheel pairs is an idler pair, and the other of the upper and lower sprocket wheel pairs is a driven pair, driving the pair of chains and the plurality of steps attached thereto. The set of tracks for the first set of wheels is so configured that it assures that the treads of the steps in the passenger carrying flight are horizontal. The set of tracks for the first set of wheels is further configured to assure that the treads assume a continuous belt-like configuration about the upper and lower sprocket wheel sets and throughout the return flight. The second set of shaft mounted wheels rides upon its own separate set of tracks.

The overall framework of the escalator assembly also mounts a pair of balustrades, which support moving handrails, as is well known. At least in the area of the moving steps, the balustrades are provided with continuous skirts between which the steps pass. The skirts are made of adjacent panels of low friction material such as stainless steel or enameled metal.

As will be appreciated, because of their length it is virtually impossible to provide balustrade skirts which are perfectly planar and totally free of waiver. The steps are generally fabricated or cast of metal and by virtue of their fabrication or casting may vary slightly in dimensions within acceptable tolerances. Furthermore, to prevent binding there must be a certain amount of play between the first and second sets of wheels of each step and their respective sets of rails. Bearings provide additional play, and all of these elements contribute to some lateral or side-to-side shifting of the steps during their travel. This lateral motion may be amplified by wear and uneven loading of the tread due to the position of the passenger.

From the above, it will be understood that a small gap between the moving stairway and each of its skirts must be provided. In fact, differences in the distance between the skirts at various positions along their length, variations in the width of the steps as a result of the manner in which they are manufactured, tolerances, alignments, and the like assure that these gaps are, indeed, unavoidable. Failure to provide gaps between the stairway and the adjacent balustrade skirts would result in binding, wear, vibration and noise. By code, in the United States, the gap between each step side and the adjacent balustrade skirt is not to exceed 3/16 inch.

It is desirable to minimize the width of these gaps to prevent foreign material from getting into the escalator mechanism. More importantly, however, it is desirable to minimize these gaps for reasons of safety. The narrower these gaps are, the less chance there is that the clothing, footwear or extremities of a passenger could be drawn into either of these gaps resulting in damage to the clothing and injury to the passenger.

Prior art workers have approached this problem in a number of different ways. One approach has been to provide lateral guidance for the moving stairway to minimize lateral movement thereof. An example of this is taught in U.S. Pat. No. 2,813,613 wherein castors are mounted on the brackets of each step, and engage and ride along the skirts. British patent specification 519,149 teaches the provision of an edge rib on either end of each tread, the edge rib being so configured as to make the passenger slightly uncomfortable should he step upon it so that he will automatically move his foot inwardly from the edge of the step tread and away from the adjacent gap.

U.S. Pat. No. 3,144,118 teaches the application of low friction coatings on the skirt thereby reducing the chances of clothing, footwear or the like being drawn into the gap by the relative movement of the steps and the skirts. U.S. Pat. No. 3,191,743 teaches a moving walkway wherein the skirts are provided with resilient ribs which extend into and ride through the first tread groove at each side of each tread.

U.S. Pat. No. 2,981,397 teaches the provision of a removable resilient cleat along each side edge of each step tread. If the weight of the passenger is applied to this cleat, it will bend toward the skin, closing the gap therebetween. In a somewhat similar fashion, British patent specification 1 276 922 teaches the provision of a barrier means affixed to each side of each stair tread. The barrier means prevents the passenger's foot from approaching either gap between the tread sides and the adjacent skirts.

U.S. Pat. No. 3,986,595 teaches a safety device located at either side of each step of an escalator. If the passenger should contact the safety device, it will shift to close the gap between the step side and the adjacent skirt. U.S. Pat. No. 4,374,558 teaches an escalator step wherein the tread is provided with front-to-rear ribs which are formed on a press. The endmost portions of the tread are formed without ribs. Ribbed inserts are attached to the tread in these endmost ribless areas and are so located to assure that each tread has the same predetermined side-to-side dimension.

Finally, U.S. Pat. Nos. 4,236,623; 4,397,383; 4,413,719 and 4,519,490 teach the provision of resilient inserts mounted along the side edges of each tread so as to minimize the adjacent tread/skirt gap. In some instances, any pressure applied to the resilient strips will cause them to form a closure seal with the adjacent skirt. In some instances, the resilient members have portions which actually contact the skirt substantially continuously.

All of these approaches have both advantages and disadvantages. Where actual substantially continuous contact between a gap closing member and an adjacent skirt takes place, wear will result, and sometimes noise and vibration will result as well. None of these approaches provide an adjustable gap minimizing means, enabling a final adjustment of the assembled escalator.

The present invention is based upon the discovery that better results can be achieved by providing steps having treads with conventional fore-to-aft alternate ribs and grooves, but with a predetermined number of ribs removed at each side of the tread to provide planar surfaces at each tread side. Separate ribbed tread inserts are affixed to the planar tread surfaces and are laterally adjustable thereon. Riser inserts may also be affixed to the side edges of the riser of each step. The adjustable inserts avoid a non-conformance product assembly; enable reasonable tolerances in the manufacture of the parts of the escalator; and enable reasonable tolerance in the alignment of the escalator track system and the balustrade skirts.

The ribbed inserts are preferably made of ultra-high molecular weight plastic. Attachment and adjustment of the tread inserts constitute the final adjustment of the escalator during its assembly and installation. The gap between each tread insert and the adjacent skirt is preferably set at about 1/16 inch on a static basis.

DISCLOSURE OF THE INVENTION

According to the invention there is provided a pair of mirror image inserts mountable on the top surface of the treads of escalator steps and walkway segments enabling adjustment of the gaps between the sides of the tread and the adjacent balustrade skirts. The top surface of each tread has a plurality of evenly spaced ribs thereon which define grooves therebetween. The ribs extend from the front edge to the rear edge of the tread. Adjacent each of its sides, the top surface of the tread is provided with recessed, planar, unribbed surfaces, which extend from the front edge to the rear edge of the tread and inwardly from the side edges thereof.

The inserts are mirror images of each other and are provided with ribs extending from their forward edges to their rearward edges and having the same spacing as the tread ribs. Each insert is mountable on its respective one of the planar surfaces of the tread and extends from the forward edge to the rearward edge thereof. A downwardly depending skirt is provided on the outer edge of each insert, the skirt covering the adjacent side edge of the tread. The inserts are laterally adjustable on the tread enabling minimization of the gap between each tread side and the adjacent balustrade skirt. In the case of a escalator step, inserts may also be affixed to the side edges of the riser.

The inserts are preferably molded of ultra high molecular weight plastic. The inserts may be made up of two different types of plastic, the bulk of the insert comprising a plastic which will provide adequate traction for safe engagement by the passenger's footwear, and the endmost portion of the insert, facing the adjacent balustrade skirt, being made of a bearing plastic.

DETAILED DESCRIPTION OF THE INVENTION

As indicated above, while the teachings of the present invention are applicable to segmented moving walkways and the like, for purposes of an exemplary showing, it will be described in terms of its application to escalator steps.

Figure 1:
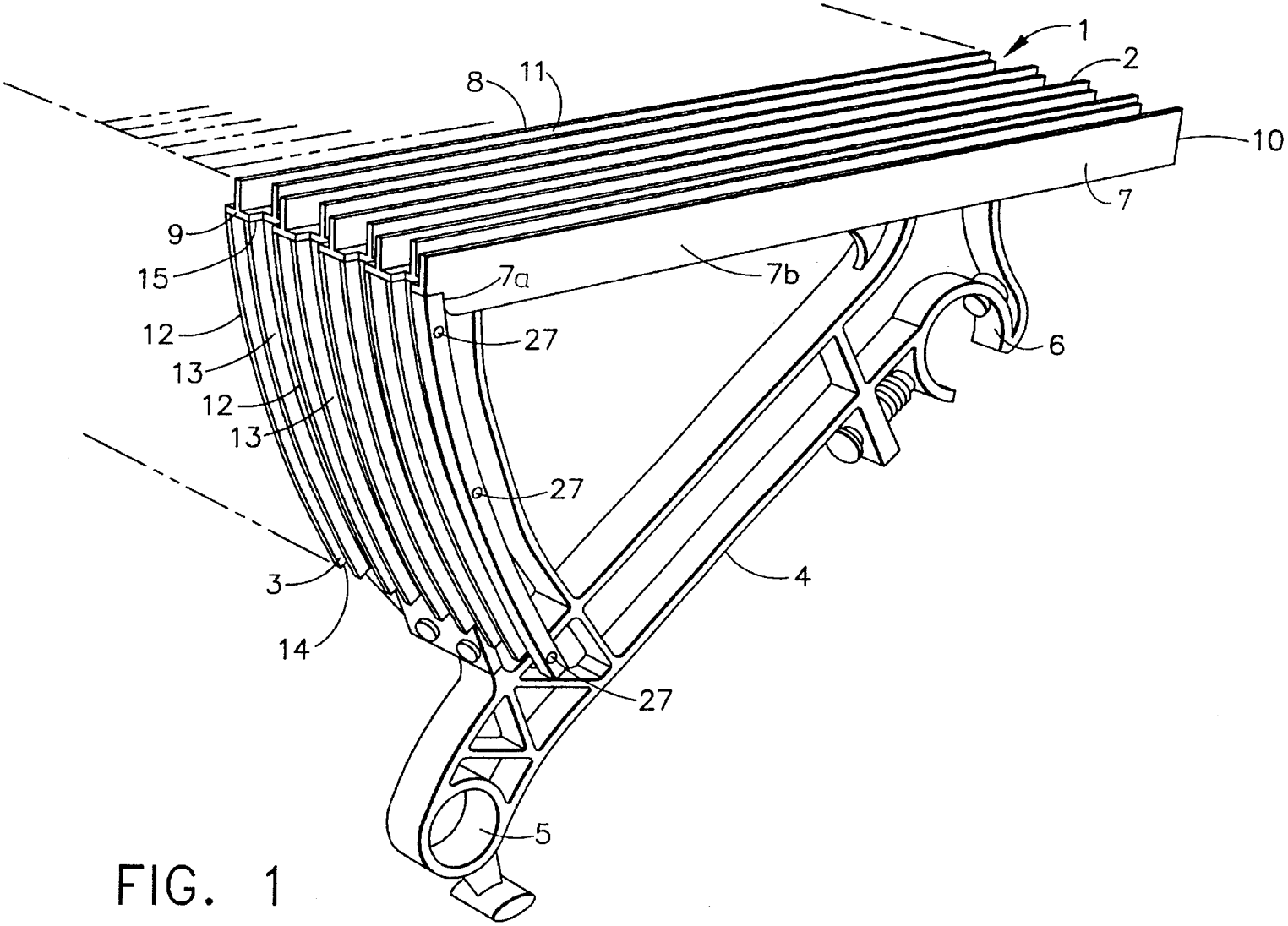
FIG. 1 is a fragmentary perspective view of a conventional escalator step.

To this end, reference is first made to FIG. 1 wherein an exemplary conventional prior art escalator step is fragmentarily illustrated. The step is generally indicated at 1 and comprises a tread 2 and a riser 3. The tread 2 and riser 3 are affixed to the framework of the step. The nature of the framework does not constitute a limitation of the present invention. Among other things, the framework comprises a pair of substantially triangular side frames, one of which is shown at 4. The side frame not shown is essentially the same as the side frame 4. Side frame 4 has an opening 5 for receipt of a first shaft (not shown), carrying a first pair of wheels (not shown). The side frame 4 (and its counterpart not shown) has a second partial bore 6, adapted to receive a second shaft (not shown) and a second pair of wheels (not shown). The first set of wheels located beneath riser 3 rides upon a set of tracks (not shown) so configured as to cause the steps to achieve an orientation wherein the tread 2 is horizontal for transport of a passenger up or down the escalator. Contact of the first set of wheels on their respective rails also causes the tread of each step to assume a continuous belt-like orientation at the top and bottom of the escalator and along the return flight of the steps. The second set of wheels not only supports the adjacent edge of the step, but the shaft passing through the opening 6 is also operatively attached to a pair of continuous chains which pass over a pair of sprocket wheels (not shown) at the top of the escalator and a pair of sprocket wheels (not shown) at the bottom of the escalator. One of the upper and lower pairs of sprocket wheels is an idler pair, while the other pair is a driven pair. The second set of step supporting wheels rides on its own set of rails (not shown).

Figure 2:
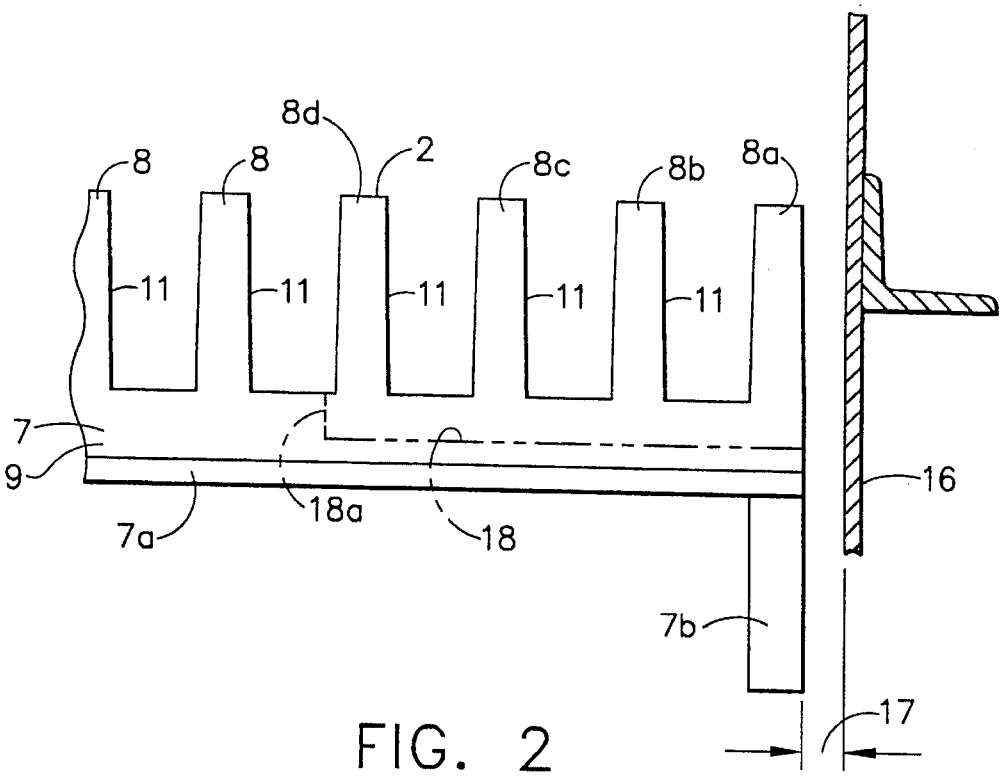
FIG. 2 is a fragmentary, front elevational view of a tread modified in accordance with the present invention.

Referring to FIGS. 1 and 2, the tread 2 comprises a substantially rectangular plate 7 having a plurality of integral upstanding ribs 8. The ribs extend from the forward edge 9 of the tread 2 to its rearward end 10. The ribs 8 are arranged in parallel spaced relationship, defining grooves 11 therebetween. The ribs and the grooves therebetween have dimensions dictated by code. For example, the grooves 11 should be not more than one quarter inch wide, not less than 3/8 inch deep and the grooves should have 3/8 inch centers.

The riser 3 may also be provided with ribs 12 in parallel spaced relationship, defining grooves 13. The ribs 12 and grooves 13 extend from the bottom edge 14 to the top edge 15 of riser 3, as viewed in FIG. 1. It will be noted that the riser 3 is of arcuate configuration from bottom edge 14 to top edge 15. It will further be noticed that the ribs 12 of riser 3 are staggered with respect to ribs 8 of tread 2. This enables the tread ribs 8 at the rear edge 10 of the tread to interdigitate with the ribs 12 of the riser 3 of the next adjacent step (not shown in FIG. 1) so that during shifting of the treads to their belt-like deployment, the rear ends of the ribs of each tread will clean the grooves of the riser of the next adjacent step, all as is well known in the art.

The tread plate 7 has a forward notch 7*a* to accommodate the upper edge of riser 3 and downwardly depending longitudinal flanges along the sides of the tread 2, one of which is shown at 7*b* in several of the Figures.

As is further well known in the art, the endless procession of steps moves between a pair of balustrade skirts. One such balustrade skirt is shown at 16 in FIG. 2. Balustrade skirt 16 is normally made of a low friction material such as stainless steel, porcelain enamel steel or the like. In addition, a stainless steel skirt, for example, may have an additional layer of low friction material applied thereto or mounted thereon. Such an additional layer is not shown in FIG. 2.

As indicated above, for reasons of safety and to minimize entry of foreign material into the escalator mechanism, it is desirable to have the clearance gap 17 between the tread 2 and the skirt 16 as narrow as possible. It is preferred that a minimum gap be maintained to prevent wear of the parts, vibration and noise.

To achieve minimization of gap 17 and control thereof, a predetermined number of ribs are eliminated from each end of tread plate 7. In FIG. 2, the endmost ribs 8*a*, 8*b*, 8*c* and 8*d* are to be totally eliminated and are to be replaced by a recessed planar surface 18. It will be understood that the same is true of that end of tread 7 not shown in FIG. 2. Removal of ribs 8*a*–8*d* can be accomplished by machining or the like, or these ribs can simply be eliminated in the tread manufacturing process, whether it be a casting process, a machining process, or a combination thereof.

Figure 3:
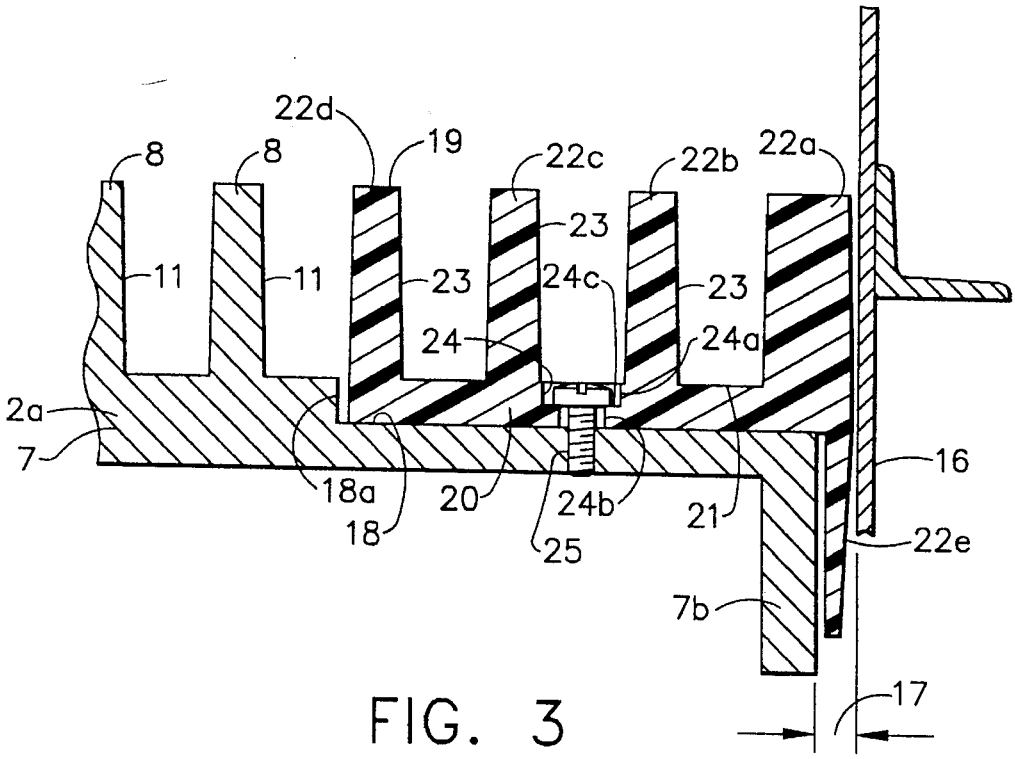
FIG. 3 is a fragmentary elevational, cross-sectional view of a tread provided with an insert of the present invention.
Figure 4:
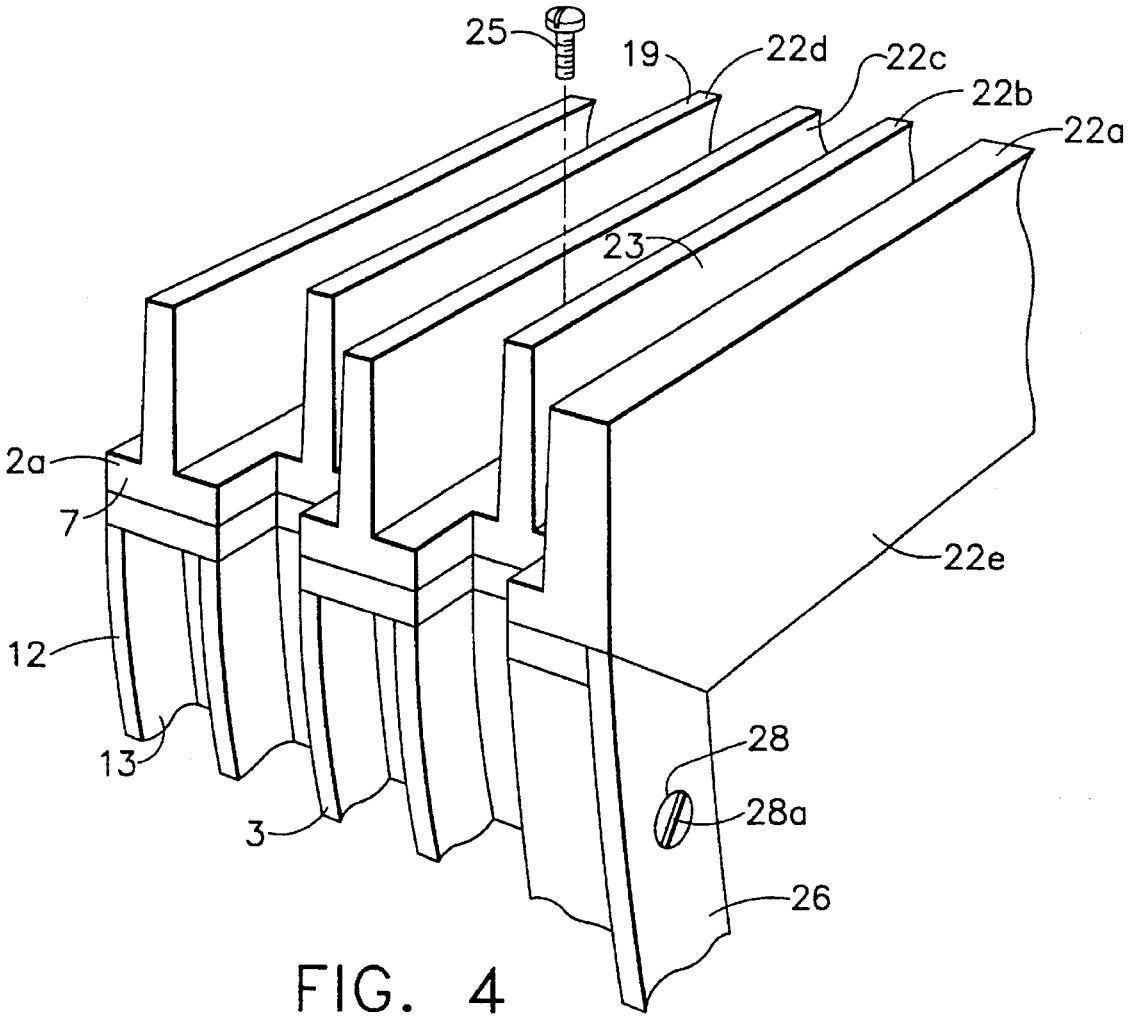
FIG. 4 is a fragmentary perspective view of the structure of FIG. 3 provided with a riser insert.

Reference is now made to FIGS. 3 and 4. In these Figures, it will be noted that the missing ribs 8*a*–8*d* have been replaced by an insert 19. Insert 19 may be made of any appropriate metallic or plastic material. Preferably, insert 19 is molded ultra high molecular weight plastic such as that sold by the Poly-Hi Division of Menasha Corporation of Fort Wayne, Ind., under the mark TIVAR®-TL. The plastic preferably has surface characteristics providing suitable traction for the footwear of a passenger.

Insert 19 has a base portion 20 with a planar bottom surface 21 adapted to rest upon tread surface 18. It will be noted that the thickness of the base portion 20 of insert 19 is approximately the same as the depth by which the tread surface 18 is recessed. The insert 19 has a series of integral, upstanding ribs 22*a*–22*d* which are arranged in parallel spaced relationship, defining intervening grooves 23. The ribs 22*a*–22*d* and the grooves 23 have dimensions similar to ribs 8 and grooves 11, with the exception that the endmost rib 22*a* is slightly wider so as to extend beyond the end of surface 18. The somewhat wider rib 22*a* has a downwardly depending flange 22*e* which extends into the gap 17. It will be understood that the insert 19, together with its ribs 22*a*–22*d* and grooves 23 extends from the front edge 9 to the rear edge 10 of the tread. It will further be understood that the tread 2*a* of FIG. 3 differs from the tread 2 of FIGS. 1 and 2 only in the elimination of original ribs 8*a*–8*d* and the formation of recessed planar surface 18, with similar treatment at the other end of the tread.

Along its length, the central one of grooves 23 has a plurality of holes formed at that portion of insert base 20 defining the bottom of the central groove 23. One such hole is shown at 24. The hole 24 has upper and lower portions 24*a* and 24*b*, both of which are transversely elongated in a direction extending from side-to-side of insert 19. In the direction extending between the front and rear edges of insert 19, the lower portion 24*b* of hole 24 has a dimension to just nicely receive the shank of machine screw 25. In the same direction, the upper portion 24*a* of 24 has a dimension to just nicely receive the head of screw 25. The upper hole portion 24*a* and the lower hole portion 24*b* form between them shoulder 24*c* engagable by the head of screw 25. While not absolutely required, the shoulder 24*c* is preferably obround to provide machine screw 25 with the greatest holding effect on the insert 19. The screw 25, when in place, is recessed in hole 24 as shown. It will be understood that all of the other holes at the base of central groove 23 will be of identical configuration.

It will be apparent from FIG. 3 that hole 24 and its counterparts and the machine screw 25 and its counterparts enable lateral shifting of insert 19 toward and away from skirt 16. It will be apparent, for example, that if insert 19 is shifted to the left as viewed in FIG. 3, until the downwardly depending flange 22*e* abuts the end of tread 7, the screw 25 will be in abutment with the right hand end of hole 24 and the left hand end of insert 19 will lie adjacent the shoulder 18*a* formed in tread plate 7 by the recessed planar surface 18. In a similar fashion, insert 19 may be shifted to the right as viewed in FIG. 3, until it abuts or nearly abuts the skirt 16.

From the description above, it will be understood that when each end of each tread is provided with an insert identical to insert 19 of FIG. 3 these inserts can be applied to each tread as a last step in the assembly and installation of the escalator. Since the inserts are laterally adjustable until screw 25 and its counterparts are tightened, each insert can be adjusted under static conditions with the aim of reducing gap 17 to about 1/16 inch. The gap is set such that throughout the majority (and preferably all) of its movement, insert 19 will not contact skirt 16. This is true of all of the inserts on all of the treads.

It is also within the scope of the present invention to provide a riser insert at each side edge of riser 3. One such riser insert is shown at 26 in FIG. 4. It will be understood that the riser insert at the other end of riser 3 will be a mirror image of insert 26. For this purpose, the end edges of riser 3 are provided with threaded perforations, three of which are shown at 27 in FIG. 1. The riser insert will be provided with corresponding countersunk perforations, one of which is shown at 28 in FIG. 4. In this way, riser insert 26 is affixed to the end of riser 3 by means of machine screws, one of which is shown at 28*a*. The heads of the screws 28*a* are recessed, and are inset slightly from the surface of riser insert 26, so as not to mar or scratch the adjacent balustrade skirt (not shown) should the riser insert 26 contact the skirt. The outside surface of riser insert 26, which faces the adjacent skirt, may be made substantially coplanar with the corresponding surface of flange 22*e* of the adjacent tread insert 19 by any appropriate means including shim means (not shown) or by selection of a riser insert 26 of appropriate thickness.

Figure 5:
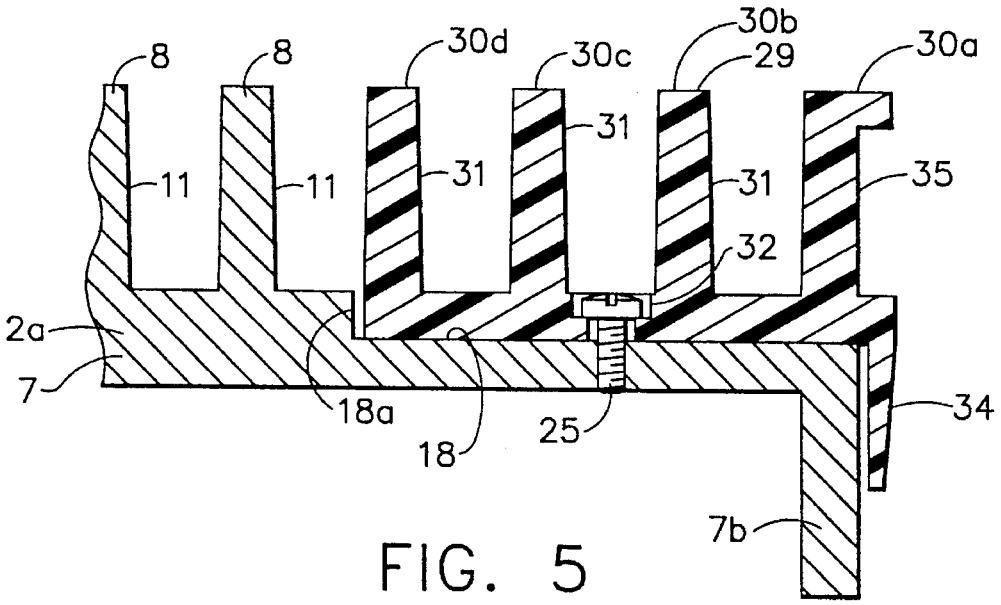
FIG. 5 is a fragmentary, elevational, cross-sectional view, similar to FIG. 3, and illustrating an extruded insert.

FIG. 5 illustrates the tread 2*a* with its ribs 8, grooves 11 and slightly depressed planar end surfaces, one of which is shown at 18. FIG. 5 illustrates an insert 29 having ribs 30*a*–30*d* and grooves 31 therebetween. The ribs 30*a*–30*d* and grooves 31 are similar to the ribs 22*a*–22*d* and grooves 23 of the embodiment of FIG. 3. Insert 29 is provided with a plurality of elongated holes (one of which is shown at 32), equivalent to hole 24 of FIG. 3, and adapted to receive machine screws 25. The insert 29 is provided with a downwardly depending flange 34, equivalent to flange 22*e* of FIG. 3. The only difference between insert 29 of FIG. 5 and insert 19 of FIG. 3 is the fact that insert 29 is extruded, rather than molded. As a consequence, the outside surface of rib 30*a* may be relieved, as at 35, for material savings.

Figure 6:
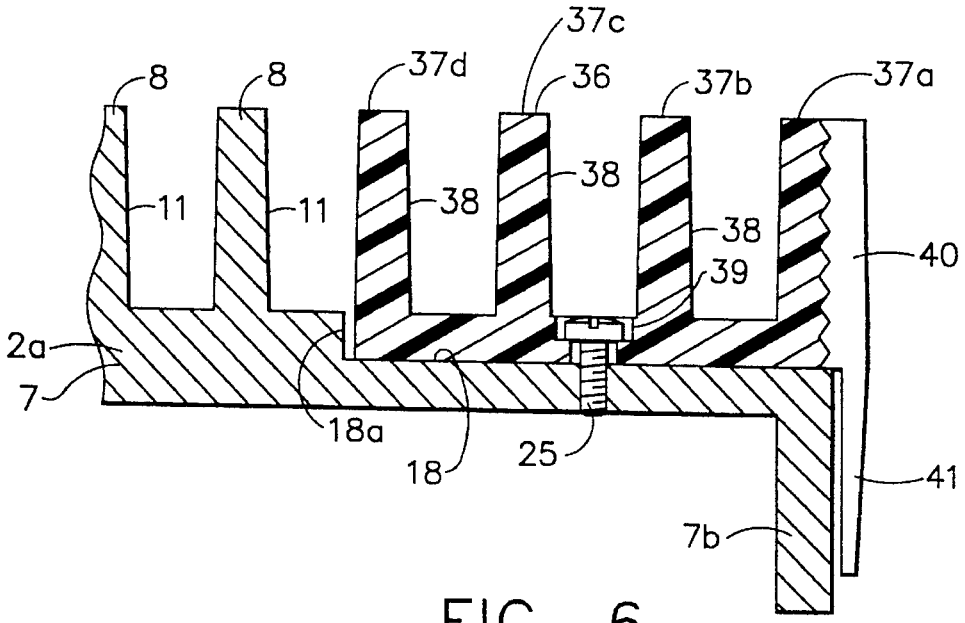
FIG. 6 is a fragmentary, elevational, cross-sectional view, similar to FIG. 5, and illustrating an insert made of two different types of plastic.

Reference is made to FIG. 6 wherein the tread 2*a* is again shown, provided with yet another insert 36. Insert 36 is similar to insert 19 of FIG. 3 having four upstanding ribs 37*a*–37*d* with grooves 38 therebetween. Again, insert 36 is provided with elongated openings (one of which is shown at 39), equivalent to elongated opening 24 of FIG. 3.

Figure 7:
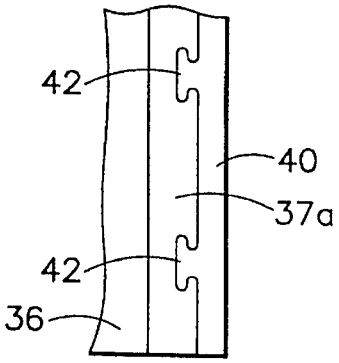
FIG. 7 is a fragmentary plan view of the endmost rib of FIG. 6, wherein the endmost rib is made of two different plastic materials mechanically joined together.

The insert 36 differs from insert 19 and is made up of two different plastic materials. The majority of insert 36, including a part of rib 37*a*, is made of an ultra-high molecular weight plastic material having surface characteristics which would provide adequate traction for the footwear of a passenger. The outermost part 40 of rib 37*a*, including the skirt 41 is made of an ultrahigh molecular weight plastic material having good bearing characteristics. The portion 40 may be affixed to rib 37*a* by co-extrusion processes, known in the art. Alternatively, the portion 40 may be adhered to the other part of rib 37*a* by adhesive means. As yet another alternative, the part 40 may be affixed to rib 37*a* by mechanical means such as riveting or the like. FIG. 7 is a fragmentary plan view of rib 37*a* and part 40 wherein they are molded with mechanical interlocking means, as at 42.

Figure 8:
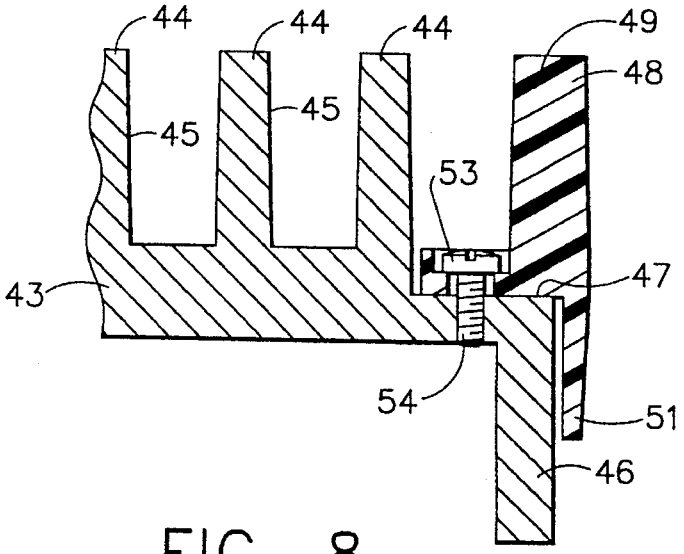
FIGS. 8, 9 and 10 are fragmentary, elevational, cross-sectional views of one, two and six rib inserts, respectively.

The width of the inserts mounted upon the tread does not constitute a limitation of the present invention. This is demonstrated in FIGS. 8–10. In FIG. 8, a tread plate 43 is shown, similar to tread plate 7 of FIGS. 3–6, having upstanding ribs 44 defining grooves 45. The tread plate 43 has a downwardly depending skirt 46. Tread plate 43 differs from tread plate 7 of FIGS. 3–6 in that only the endmost rib has been deleted, forming the recessed planar surface 47. To this end, an insert 48 is provided having only a single upstanding rib 49 and a base portion 50 adapted to rest upon tread plate surface 47. The insert has a downwardly depending skirt 51.

The base portion 50 of insert 48 is provided with an elongated hole 52 (similar to hole 24 of FIG. 3) adapted to receive machine screw 53 which is engaged in a threaded perforation 54 in tread plate 43. It will be understood that there will be a series of screws 53 and holes 52 along the length of insert base 50, which extends from the forward edge of tread plate 43 to the rearward edge of tread plate 43. It will be apparent that insert 48 is shiftable laterally so as to be adjustable and capable of minimizing the gap between the side edge of tread plate 43 and the adjacent balustrade skirt (not shown). A similar single-ribbed insert (not shown) will be affixed to the other end of tread plate 43, in the same manner.

Figure 9:
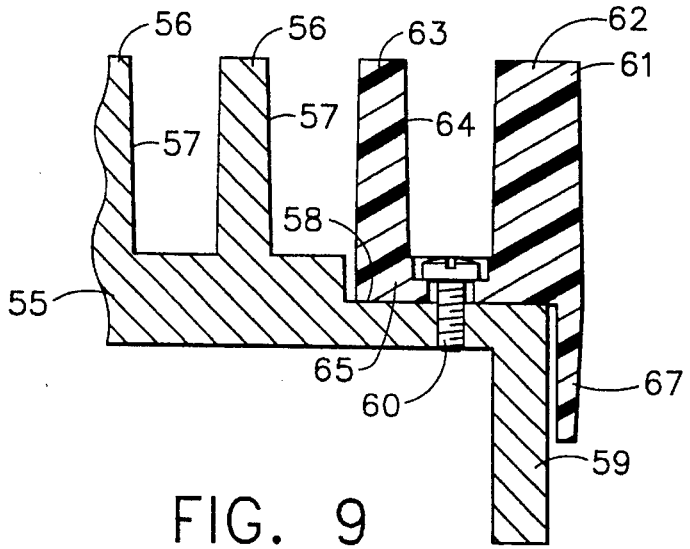

FIG. 9 illustrates a tread plate 55 provided with upstanding ribs 56 which define grooves 57. In this instance, the tread plate 55 is provided with a recessed planar surface 58 having a transverse width equivalent to two of the ribs 56 and an intervening groove 57. The tread plate is completed by a downwardly depending flange 59 and threaded perforations 60 in planar surface 58. In this instance, an insert 61 is provided having two upstanding ribs 62 and 63 with an intervening groove 64. The insert has a base 65 provided with a plurality of elongated holes (equivalent to hole 24 of FIG. 3), one of which is shown at 66. The insert is completed by a downwardly depending skirt 67. The insert extends from the forward edge of tread plate 55 to the rearward edge thereof.

The insert 61 is transversely shiftable in the same manner described with respect to the previous inserts and is therefore capable of adjusting and minimizing the gap between the end of tread plate 55 and the adjacent balustrade skirt. The other side of tread plate 55 will be provided with an insert constituting a mirror image of insert 61, affixed to the tread plate 55 in precisely the same manner.

Figure 10:
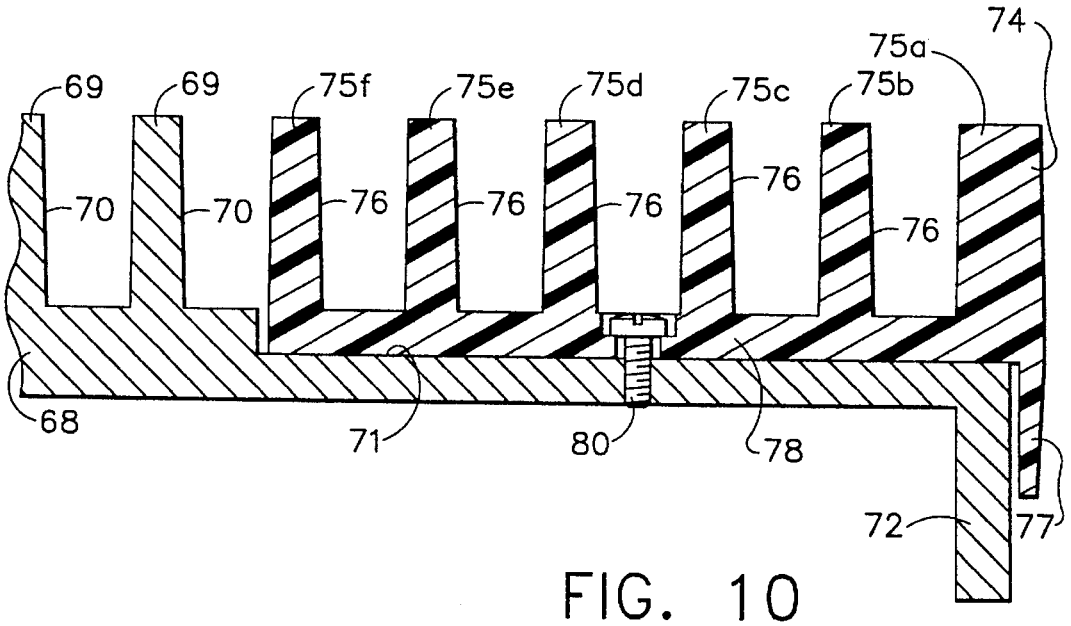

Finally, FIG. 10 illustrates a tread embodiment 68 having upstanding ribs 69 defining intervening grooves 70. The tread plate 68 has a recessed planar end surface 71 which has a width equivalent to six upstanding ribs 69 and intervening grooves 70 therebetween. The tread plate 68 has a downwardly depending flange 72 and a series of threaded bores, one of which is shown at 73. It will be understood that the other end of tread plate 68 will be identically configured.

In this embodiment, an insert 74 is provided with a plurality of upstanding ribs 75*a*–75*f* with intervening grooves 76. The insert has downwardly depending skirt 77. At the center one of the grooves 76, the base 78 of insert 74 is provided with a series of transversely elongated holes 79 (similar to hole 24 of FIG. 3) for receipt of machine screws, (one of which is shown at 80), threadedly engaged in their respective ones of threaded perforations 73. The insert 74 extends from the forwardmost edge of tread plate 68 to the rearwardmost edge thereof, and is transversely shiftable along surface 71 whereby to adjust the gap between the end of tread plate 68 and the adjacent balustrade skirt (not shown). It will be understood that a mirror image insert (not shown) will be provided at the other end of tread plate 68 and will be adjustably mounted thereto in the same manner.

The insert 74 has a transverse width of about 2 inches. The ultrahigh molecular weight plastic material from which insert 74 is molded or extruded may be formulated to have a yellow color, or may be painted yellow so as to provide a danger indication.

While, as indicated above, the width of the inserts of the present invention does not constitute a limitation, it is believed that it would seldom be necessary to provide inserts with more than about six ribs.

All of the embodiments of inserts of the present invention may be made of two different types of plastic material, as described with respect to FIGS. 6 and 7. All of the inserts may be brightly colored for warning purposes. All of the embodiments permit final adjustment on a static basis, as the last step in the assembly and installation of the escalator.

Modifications may be made in the invention without departing from the spirit of it.

What is claimed:

1. In combination with escalators and moving walkways of the type having a continuous flight of treads which moves between balustrade skirts with a gap between each balustrade skirt and said flight for at least most of the length of said flight, a pair of inserts for each tread and affixable to each tread to adjust the width of said gaps, each tread having a top surface, side edges, and front and rear edges, said top surface of each tread being provided with evenly spaced ribs defining grooves therebetween, said ribs and grooves extending from said front edge to said rear edge of said tread, said top surface of each tread, adjacent the side edges thereof, having unribbed recessed surfaces extending from said front edge to said rear edge of said tread, said inserts being located on said recessed surfaces of said tread, extending from said front edge to said rear edge of said tread, and means for attaching said inserts to their respective recessed surfaces so as to be laterally adjustable whereby to enable the minimizing of said gaps between said treads and said balustrade skirts and so as to be fixable on their respective recessed surfaces in adjusted positions thereon, said inserts being out of contact with said balustrade skirts throughout at least the majority of their travel therealong.

2. The structure claimed in claim 1 wherein each of said inserts has a downwardly depending flange covering the adjacent side edge of its respective tread.

3. The structure claimed in claim 1 wherein said inserts have longitudinal ribs and grooves having the same spacing as said ribs and grooves of said treads, said ribs and grooves of said inserts constituting a continuation of the ribs and grooves of said tread when said inserts are in place on their respective recessed surfaces of said tread.

4. The structure claimed in claim 1 wherein said means for attaching each insert to its respective recessed surface of its respective tread comprises a first set of threaded bores formed in said recessed surface and aligned parallel to the adjacent tread side edge, said insert having a corresponding second set of bores formed therein, a machine screw for each of said bores of said second set, said machine screws each having a threaded shank and a head, each of said bores of said second set being elongated transversely of said insert, each of said bores of said second set having a lower portion with a width to accommodate said shank of its respective machine screw and an upper portion having a slightly greater width to accommodate said head of its respective machine screw in recessed fashion, a shoulder structure defined between said upper and lower portions of each bore of said second set, said insert being attached to its respective tread recessed surface by said machine screws passing through said second set of bores in said insert and being threadedly engaged in said corresponding first set of bores, said insert being shiftable laterally on said recessed surface to adjust said gap between said tread side edge and said adjacent one of said balustrade skirts, said insert being fixable in adjusted position by engagement of the head of each machine screw with the shoulder structure of its respective one of said second set of bores.

5. The structure claimed in claim 1 wherein said inserts are formed of ultra high molecular weight plastic.

6. The structure claimed in claim 3 wherein each of said inserts has a downwardly depending flange covering the adjacent side edge of its respective tread the endmost rib of each insert facing its respective one of said balustrade skirts being thicker than the other of said ribs of said insert and overhanging the adjacent side edge of said tread, said flange depending from said endmost rib.

7. The structure claimed in claim 3 wherein each insert has at least one rib and at least one groove.

8. The structure claimed in claim 3 wherein the number of said ribs and grooves on said inserts depends upon the width of said recessed surfaces of said treads.

9. The structure claimed in claim 3 wherein said lower portion, said shoulder structure and said upper portion of each of said bores of said second set are obround.

10. The structure claimed in claim 4 wherein said inserts have longitudinal ribs and grooves having the same spacing as said ribs and grooves of said treads, said ribs and grooves of said inserts constituting a continuation of the ribs and grooves of said tread when said inserts are in place on their respective recessed surfaces of said tread, said second set of bores of each insert being located along a selected groove thereof.

11. The structure claimed in claim 10 wherein each of said inserts has a downwardly depending flange covering the adjacent side edge of its respective tread, the endmost rib of each insert facing its respective one of said balustrade skirts being thicker than the other of said ribs of said insert and overhanging the adjacent side edge of said tread, said flange depending from said endmost rib.

12. The structure claimed in claim 10 wherein said inserts are formed of ultra high molecular weight plastic.

13. The structure claimed in claim 11 wherein each insert is made up of an ultrahigh molecular weight plastic material having surface characteristics providing adequate traction for the footwear of a passenger, except for a portion of said endmost rib and a corresponding portion of said flange thereof which are foraged of an ultrahigh molecular weight plastic having good bearing characteristics, said portions facing the adjacent one of said balustrade skirts.

14. The structure claimed in claim 11 wherein for a given continuous flight of treads the recessed surfaces of all treads are identical and the inserts for each tread comprise a mirror image pair, and the pairs of said treads are identical.

15. The structure claimed in claim 14 wherein all of said inserts are yellow in color.

* * * * *

UNITED STATES PATENT AND TRADEMARK OFFICE

CERTIFICATE OF CORRECTION

PATENT NO. : 5,560,468

DATED : October 1, 1996

INVENTOR(S) : Takao Inoue

It is certified that error appears in the above-indentified patent and that said Letters Patent is hereby corrected as shown below:

Column 10, line 35 (claim 13), "foraged" should read --formed--

Signed and Sealed this

Twenty-fourth Day of December, 1996

*Attest:*

Bruce Lehman

BRUCE LEHMAN

*Attesting Officer*

*Commissioner of Patents and Trademarks*